US006075501A

United States Patent [19]

Kuramoto et al.

[11] Patent Number: 6,075,501

[45] Date of Patent: Jun. 13, 2000

[54] HELICAL ANTENNA

[75] Inventors: Akio Kuramoto; Kosuke Tanabe, both of Tokyo, Japan

[73] Assignee: NEC Corporation, Tokyo, Japan

[21] Appl. No.: 09/073,853

[22] Filed: May 7, 1998

[30] Foreign Application Priority Data

May 8, 1997 [JP] Japan ..... 9-118464

[51] Int. Cl.[7] ..... H01Q 1/36

[52] U.S. Cl. ..... 343/895; 343/853

[58] Field of Search ..... 343/895, 850, 343/908, 796, 853, 858

[56] References Cited

U.S. PATENT DOCUMENTS 5,255,005 10/1993 Terret et al. ..... 343/895
5,828,348 9/1995 Tassoudji et al. ..... 343/895

FOREIGN PATENT DOCUMENTS 0 593 185 A1 10/1993 European Pat. Off. .
1-264003 10/1989 Japan .
3-274808 12/1991 Japan .
7-202551 4/1995 Japan .
8-78945 3/1996 Japan .
WO 97/11507 3/1997 WIPO .

OTHER PUBLICATIONS

A. Sharaiha, et al., "Printed Quadrifilar Resonant Helix Antenna with Integrated Feeding Network", Electronics Letters, Feb. 13, 1997, vol. 33, No. 4, pp. 256–257.

*Primary Examiner*—Don Wong
*Assistant Examiner*—James Clinger
*Attorney, Agent, or Firm*—McGinn & Gibb, P.C.

[57] ABSTRACT

A helical antenna comprising a cylindrical dielectric member 1, four spiral conductors 2*a* to 2*d* which are wound around the outer wall of the cylindrical dielectric member 1, four spiral conductors 3*a* to 3*d* which are attached to the inner wall of the cylindrical dielectric member 1, and power supply circuits 4, 5 for supplying high-frequency power to the spiral conductors 2*a* to 2*d* and the spiral conductors 3*a* to 3*d* respectively. That is, the spiral conductors serving as radiation elements are disposed at the outside and inside of the cylindrical dielectric member, and the outer and inner conductors are operated as independent helical antennas. These spiral conductors are connected to the power supply circuits for supplying the high-frequency power having desired amplitude and phase.

14 Claims, 5 Drawing Sheets

QUADRIFILAR HELICAL PATTERN

QUADRIFILAR HELICAL PATTERN

HELICAL ANTENNA

BACKGROUND OF THE INVENTION

1. Field of the Invention

The present invention relates to an antenna for a portable terminal used in a satellite communication or a ground mobile radio communication and particularly, to a helical antenna.

2. Description of the Prior Art

A helical antenna based on a conventional technique will be first explained with reference to FIG. 6 which is a perspective view showing a conventional helical antenna disclosed in Japanese Laid-open Patent Application No. Hei-7-202551.

The conventional helical antenna is designed in such a structure that helical conductors 103, 104 and helical conductors 105, 106 are helically wound around two coaxial cables 101, 102 having different lengths through supports 107, respectively. In this structure, the length of coaxial cable 101 is set to be larger than that of coaxial cable 102, and power is supplied to helical conductors 103, 104 through U balun 108 at the upper end of coaxial cable 101. The dimension of coaxial cable 102 is set so that the tip of coaxial cable 102 extends to the lower side of the winding end of helical conductors 103, 104, and power is supplied to helical conductors 105, 106 through U balun 108.

In this case, the group of coaxial cable 101 and helical conductors 103, 104, and the group of coaxial cable 102 and helical conductors 105, 106 operate as independent helical antennas. In FIG. 6, reference numeral 110, 111 represents a connector, and reference numeral 109 represents a radome.

Accordingly, in the case that each of these antennas is used as an antenna for a satellite communication terminal and a transmission frequency band and a reception frequency band are separated from each other, these antennas may be adjusted so that one of these antennas is used as an antenna for transmission and the other antenna is used as an antenna for reception. As explained above, the conventional antenna is usable in a wide frequency band because the antenna is designed in the two-stage structure.

In the conventional technique as explained above, the two independent helical antennas are piled up in the two-stage structure, and thus it has an effect of widening the frequency band, however, there is a disadvantage that the entire size of the helical antenna is large.

SUMMARY OF THE INVENTION

In order to attain the above object, a spiral conductor serving as a radiation element is disposed at each of the outside and inside of a cylindrical dielectric member. That is, a helical antenna according to the present invention comprises spiral conductors which are wound around the outer wall of a cylindrical dielectric member, other spiral conductors which are attached to the inner wall of the cylindrical dielectric member, and power supply circuits for supplying high-frequency powers to the outside and inside spiral conductors on the outer and inner walls of the cylindrical dielectric member, respectively.

Specifically, first, the outer spiral conductors wound around the outer wall of the cylindrical dielectric member and one power supply circuit for supplying powers to the outer spiral conductors constitute one independent helical antenna. Secondly, the inner spiral conductors attached to the inner wall of the cylindrical dielectric member and the other power supply circuit for supplying powers to the inner spiral conductors constitute another independent helical antenna.

Accordingly, even in the case that a sufficient frequency bandwidth cannot be obtained if the helical antenna is used alone, about two times of the frequency bandwidth can be obtained without increasing the overall size of the antenna if different adjoining frequency bands are allocated to the two antennas.

Particularly, in the case that the antenna is used as an antenna for a satellite communication terminal and the transmission frequency band and the reception frequency band are separated from each other, the antennas may be independently adjusted so that one antenna is used for the transmission and the other antenna is used for the reception.

These and other objects, features and advantages of the present invention will become more apparent in light of the following detailed explanation of the best mode embodiments thereof, as illustrated in the accompanying drawings.

DETAILED DESCRIPTION OF THE PREFERRED EMBODIMENT

A preferred embodiment according to the present invention will be explained with reference to the accompanying drawings.

Figure 1:
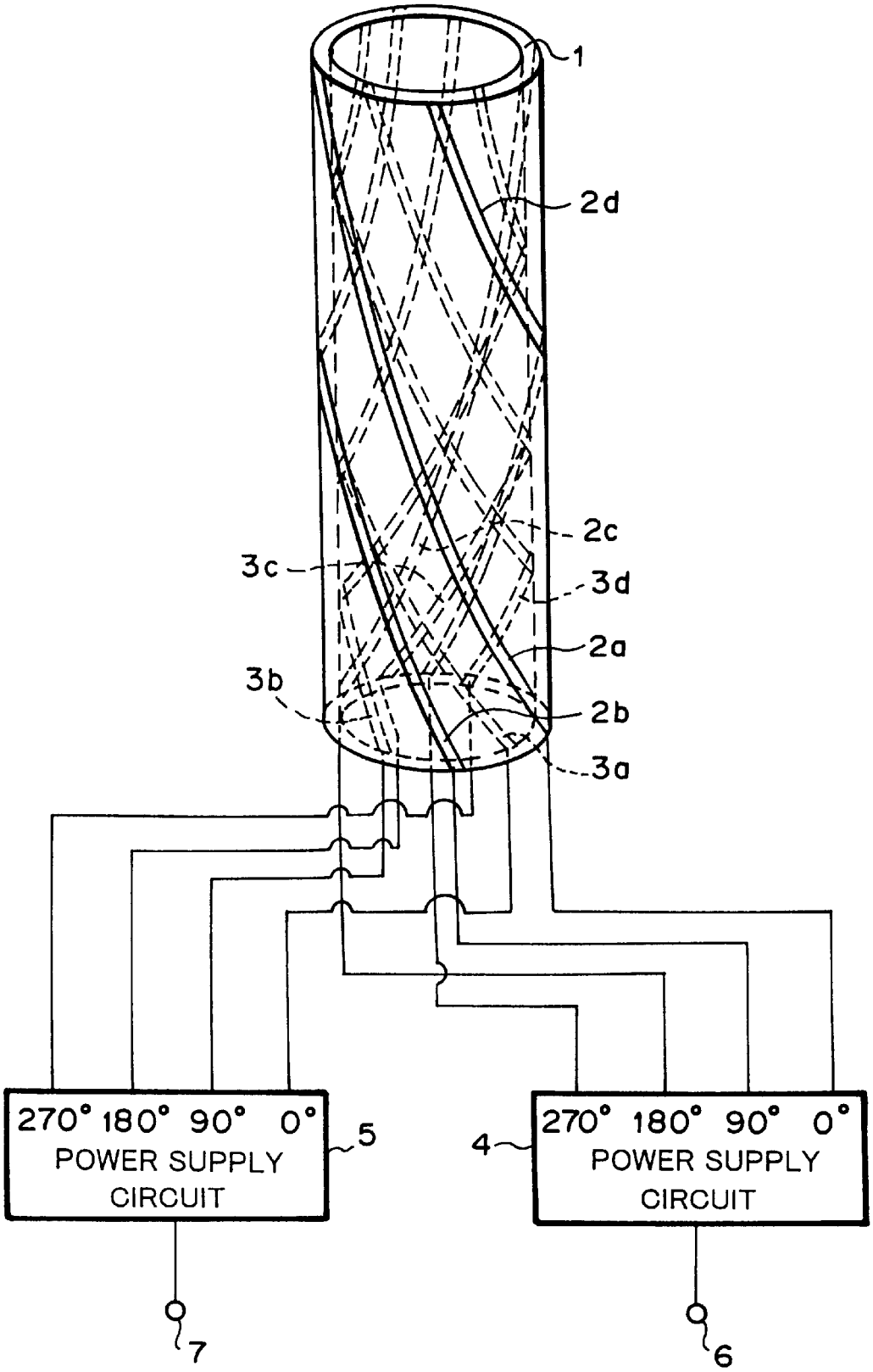
FIG. 1 is a perspective view showing a helical antenna according to one embodiment of the present invention.

FIG. 1 is a perspective view showing a preferred embodiment according to the present invention.

Referring to FIG. 1, the embodiment of the present invention comprises dielectric cylinder 1, spiral conductors 2*a*, 2*b*, 2*c*, and 2*d* disposed on the outside surface of dielectric cylinder 1, power supply circuit 4 for supplying high-frequency power to spiral conductors 2*a* to 2*d* while shifting the phase of the high-frequency power by $\pi/2$ [rad] one after another, spiral conductors 3*a*, 3*b*, 3*c*, and 3*d* disposed on the inside surface of dielectric cylinder 1, and power supply circuit 5 for supplying high-frequency power to spiral conductors 3*a* to 3*d* while shifting the phase of the high-frequency power by $\pi/2$ [rad] one after another.

Next, the operation of the helical antenna of the present invention will be explained with reference to the accompanying drawings. In FIG. 1, the high-frequency power supplied from a power supplied terminal 6 is divided into four high-frequency power parts which have the same amplitude and are shifted by $\pi/2$ [rad] in phaseone after another, and they are supplied to outside spiral conductors 2*a*, 2*b*, 2*c*, and 2*d* disposed at the outside of dielectric cylinder 1, respectively. Each of outside spiral conductors 2*a* to 2*d* to which the high-frequency power is applied radiates a circularly polarized radio wave in a direction which is determined by the arrangement and inclination of the spiral conductors. Likewise, the high-frequency power supplied from power supplied terminal 7 is divided into high-frequency power-parts which have the same amplitude and are shifted by π/2 [rad] in phase one after another, and they are supplied to inside spiral conductors 3*a*, 3*b*, 3*c*, and 3*d* disposed at the inside of dielectric cylinder 1, respectively. Each of inside spiral conductors 3*a* to 3*d* to which the high-frequency power is applied radiates a circularly polarized radio wave in a direction which is determined by the arrangement and inclination of the spiral conductors.

Next, the construction of the helical antenna of the present invention will be explained in more detail.

Figure 2:
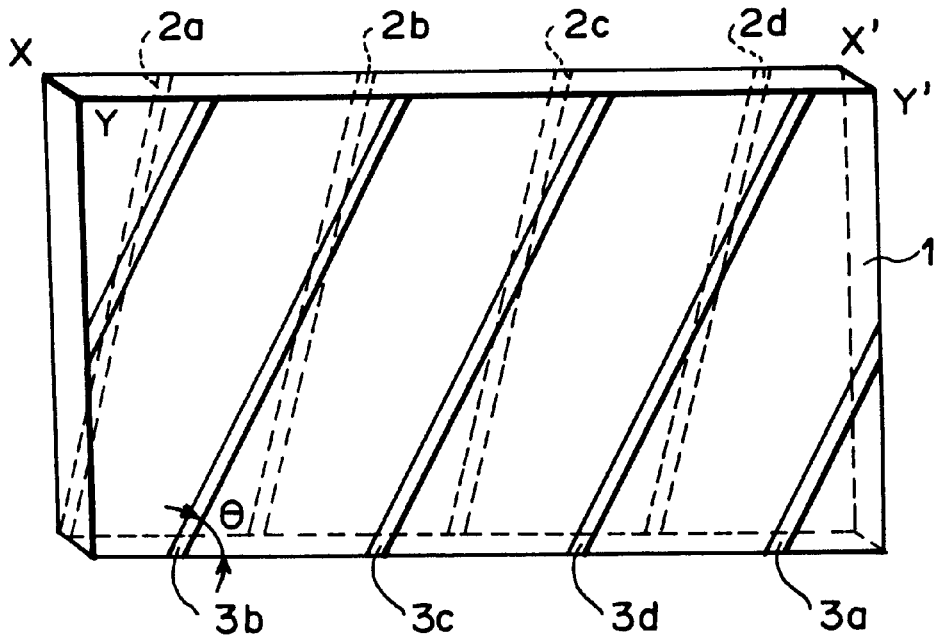
FIG. 2 is a perspective view showing a developed dielectric cylinder of the helical antenna according to one embodiment of the present invention.
Figure 3:
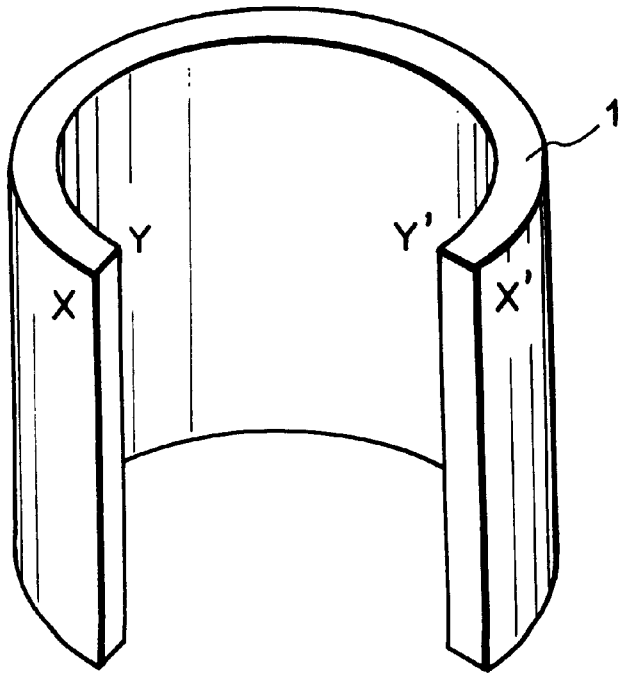
FIG. 3 is a perspective view showing the relationship of the dielectric cylinder of the helical antenna of FIG. 1 and the development of the dielectric cylinder.

FIG. 1 is a perspective view showing an embodiment of the helical antenna according to the present invention, FIG. 2 is a developed perspective view showing dielectric cylinder 1 having spiral conductors 2*a* to 2*d* and spiral conductors 3*a* to 3*d* of FIG. 1, and FIG. 3 is a perspective view showing the relationship of dielectric cylinder 1 of FIG. 1 and developed dielectric cylinder 1 of FIG. 2.

In FIG. 1, dielectric cylinder 1 is usually formed of plastic material such as polycarbonate, acrylic resin or the like, and the diameter thereof is generally set to about one tenth of the wavelength being used. The thickness of the dielectric cylinder 1 is preferably set to about one hundredth of the wavelength or less.

Particularly, when a polyester film such as Mylar or the like is used for dielectric cylinder 1, the thickness thereof is equal to 1 mm or less. The length of dielectric cylinder 1 may be set to various values in accordance with the length of spiral conductors 2*a* to 2*d* and 3*a* to 3*d*, however, it must be set to about one fourth of the wavelength at minimum. Further, the length may extend over several tens of the wavelength in some cases.

Spiral conductors 2*a* to 2*d* are disposed on the outer surface of dielectric cylinder 1, and formed of conductive material. Normally, each of conductors 2*a* to 2*d* is designed so as to be adhesively attached on the surface like a sticky tape, or dielectric cylinder 1 itself may be formed as a print substrate and conductors 2*a* to 2*d* may be formed by etching the print substrate.

Spiral conductors 3*a* to 3*d* are disposed on the inner surface of dielectric cylinder 1, and they are formed of conductive material as in the case of spiral conductors 2*a* to 2*d*. Normally, each of the conductors 3*a* to 3*d* is designed so as to be adhesively attached on the surface like a sticky tape, or dielectric cylinder 1 itself may be formed as a print substrate and conductors 3*a* to 3*d* may be formed by etching the print substrate.

Spiral conductors 2*a* to 2*d* are connected to power supply circuit 4 having power supplied terminal 6 so as to be successively supplied with the high-frequency powers which have the same amplitude and are shifted by π/2 [rad] in phase one after another. Likewise, spiral conductors 3*a* to 3*d* are connected to power supply circuit 5 having the power supplied terminal 7 so as to be successively supplied with the high-frequency powers which have the same amplitude and are shifted by π/2 [rad] in phase one after another.

FIG. 2 is a developed perspective view showing dielectric cylinder 1 on which spiral conductors 2*a* to 2*d* and spiral conductors 3*a* to 3*d* shown in FIG. 1 are arranged.

In FIG. 2, spiral conductors 2*a* to 2*d* and spiral conductors 3*a* to 3*d* are disposed on the outer and inner surfaces of dielectric cylinder 1, respectively.

Spiral conductors 2*a* to 2*d* and 3*a* to 3*d* are illustrated as straight lines in FIG. 2, however, they may be curved lines such as quadratic curves. When each spiral conductor is linear, the angle θ of the spiral conductors relative to horizon direction may be set to one of various values on the basis of the radiation direction of the radio wave. When the number of the spiral conductors on one side is equal to 2 or 4, the angle θ generally ranges from 50 degrees to 80 degrees. The width of the spiral conductors is generally set to three hundredth of the wavelength or less. The length of the spiral conductors effects the directivity of the radiation pattern, the beam width and the gain. There is a tendency that the beam width becomes narrower and the gain becomes greater as the spiral conductors become longer. When the number of the spiral conductors on one side is equal to 2 or 4, the length is generally set to the value ranging from one fourth to decuple of the wavelength.

FIG. 3 is a perspective view showing the relationship of dielectric cylinder 1 of FIG. 1 and developed dielectric cylinder 1 of FIG. 2. In FIG. 2, the plane of Y–Y' represents the inner surface of dielectric cylinder 1, and the plane of X–X' represents the outer surface of dielectric cylinder 1. If the plane of X–Y is connected to the plane of X'–Y' as shown in FIG. 3, the cylindrical shape shown in FIG. 1 is obtained. FIG. 3 schematically shows the relationship between dielectric cylinder 1 of FIG. 1 and developed dielectric cylinder 1 of FIG. 2 and one method of manufacturing the antenna of the present invention, and thus it does not limit the method of manufacturing the antenna of the present invention.

Next, the operation of the helical antenna according to the present invention will be explained.

In FIG. 1, in power supply circuit 4, the high-frequency power supplied from power supplied terminal 6 is split into four high-frequency power parts which have the same amplitude and are shifted by π/2 [rad] in phase one after another. The split high-frequency power parts are supplied to the lower ends of spiral conductors 2*a* to 2*d* disposed on the outside of dielectric cylinder 1, and circularly polarized radio wave is radiated into the space from respective spiral conductors 2*a* to 2*d* operating as radiation elements.

Likewise, in power supply circuit 5, the high-frequency power supplied from power supplied terminal 7 is split into four high-frequency power parts which have the same amplitude and are shifted by π/2 [rad] in phase one after another. The split high-frequency power parts are supplied to the lower ends of spiral conductors 3*a* to 3*d* disposed on the outside of dielectric cylinder 1, and circularly polarized radio wave is radiated into the space from respective spiral conductors 3*a* to 3*d* operating as radiation elements.

In this case, the group of power supply circuit 4 and spiral conductors 2*a* to 2*d* and the group of power supply circuit 5 and spiral conductors 3*a* to 3*d* operate as independent helical antennas, respectively. Accordingly, even in the case that a sufficient frequency bandwidth cannot be obtained with one helical antenna, about two times of the frequency bandwidth can be obtained with two helical antenna by allocating different adjoining frequency bands to the two helical antenna.

Particularly, in the case that the antenna is used as an antenna for a satellite communication terminal and the transmission frequency band and the reception frequency band are separated from each other, the antennas may be independently adjusted so that one antenna is used for the transmission and the other antenna is used for the reception.

[Embodiment]

Next, an embodiment of the present invention will be explained hereunder.

Figure 5:
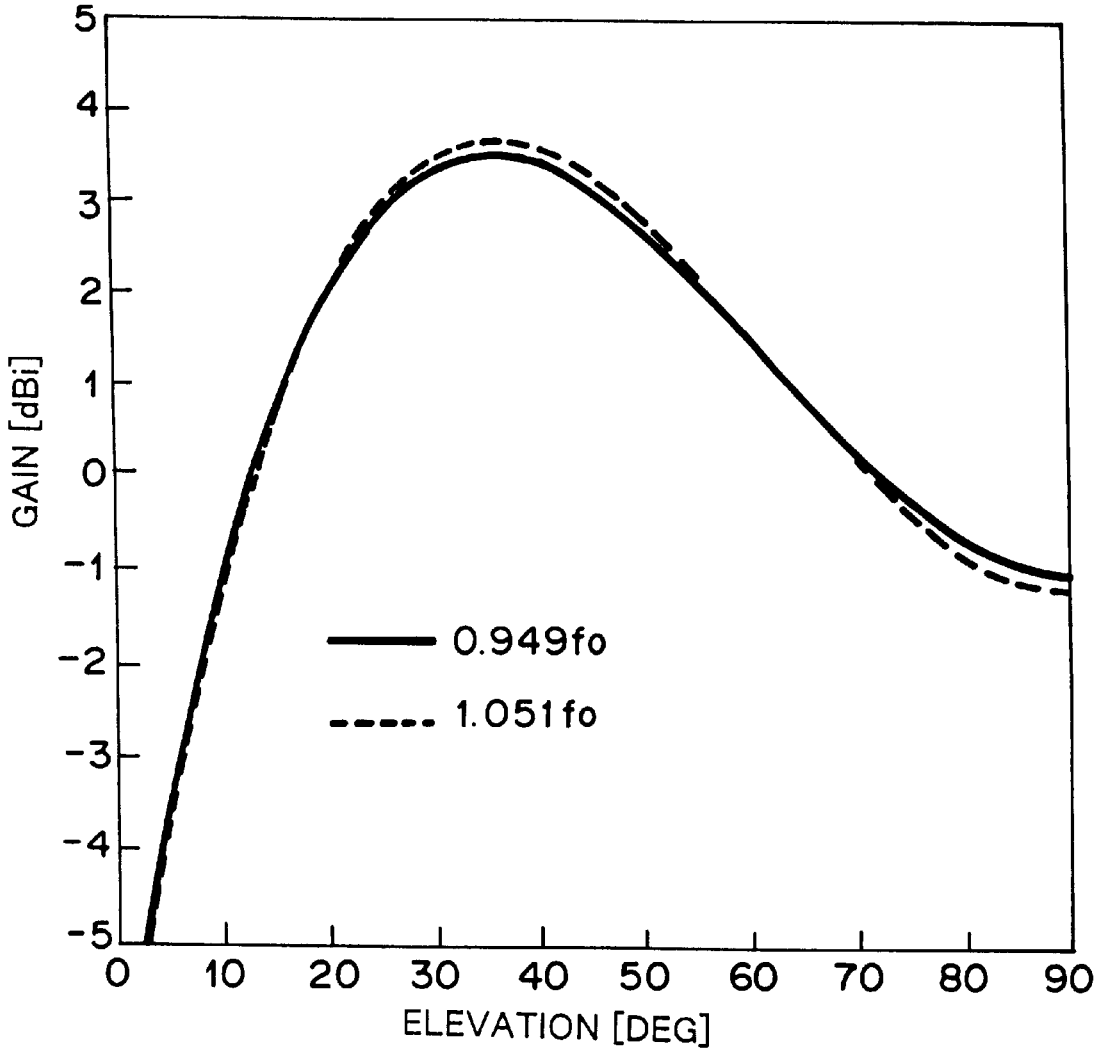
FIG. 5 is a radiation pattern diagram of the helical antenna according to the embodiment of the present invention.
Figure 6:
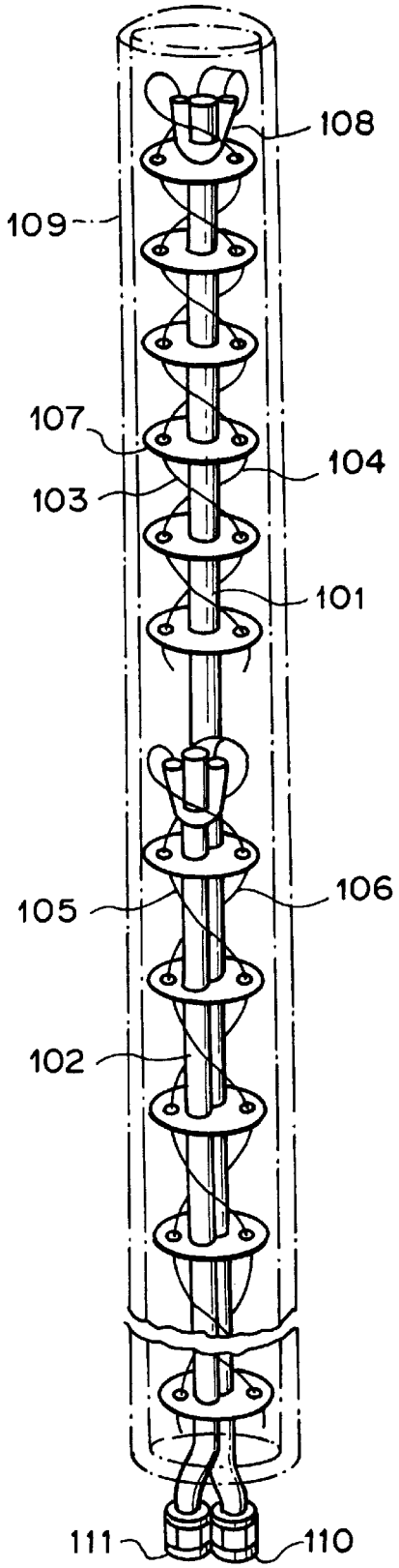
FIG. 6 is a perspective view showing a helical antenna of the prior art.

FIG. 5 shows a calculation result at frequency values 0.949 f0 and 1.051 f0 in case that the gain of 2 dBi is required at an elevation angle of 20 degree, where f0 is the center frequency of a transmission frequency band and a reception frequency band, 0.949 f0 is the lower limit of transmission frequency band ranging from 0.949 f0 to 0.963 f0, and 1.051 f0 is the upper limit of reception frequency band ranging from 1.037 f0 to 1.051 f0. The calculation was performed so as to satisfy the following conditions: the height of the helical antenna, that is, the height of dielectric cylinder 1 is equal to one and two hundredth of the wavelength or less, the diameter of the helical antenna, that is, the height of dielectric cylinder 1 is equal to seven hundredth of the wavelength or less, and the circularly polarized wave is radiated.

Figure 4:
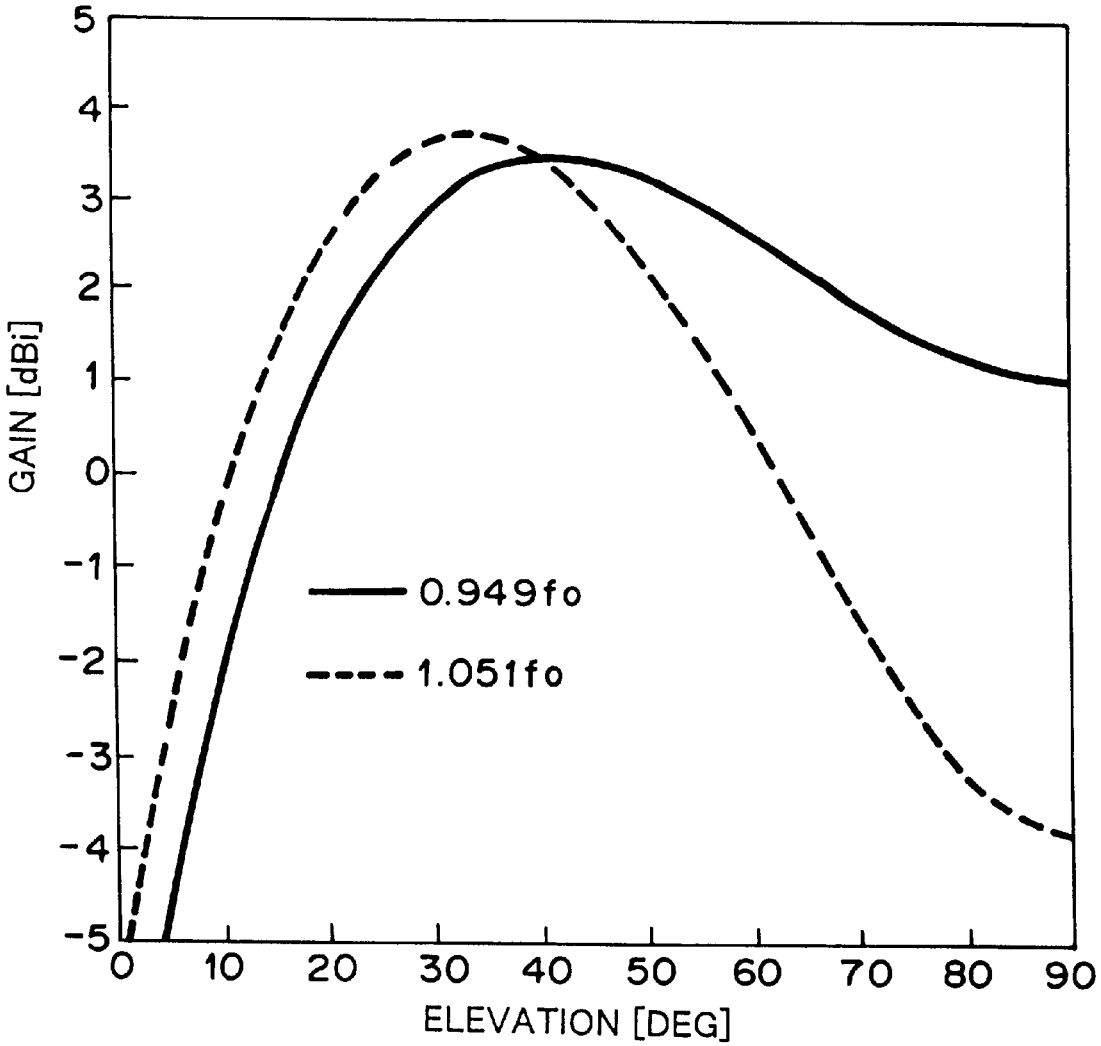
FIG. 4 is a radiation pattern diagram of a conventional single helical antenna.

FIG. 4 is a diagram showing a radiation pattern when the single helical antenna comprising power supply circuit 4 and outside spiral conductors 2*a* to 2*d* is optimized so as to cover the transmission and reception frequency bands, and FIG. 5 is a diagram showing a radiation pattern calculated when the helical antenna comprising power supply circuit 4 and outside spiral conductors 2*a* to 2*d* and the helical antenna comprising power supply circuit 5 and inside spiral conductors 3*a* to 3*d* are optimized in the transmission band and the reception band, respectively. The parameters which bring the results of FIGS. 4 and 5 are shown below:

(1) Parameters of helical antenna to obtain the radiation pattern of FIG. 4 (in the case of the helical antenna having only the outside spiral conductors)

number of spiral conductors: 4 outer diameter of dielectric cylinder: 0.0697 wavelength inclination angle of spiral conductors relative to the horizontal: 70 degrees number of turns: 1.95 height: 1.17 wavelength power supply loss: 1.2 dB (2) Parameters of helical antenna to obtain the radiation pattern of FIG. 5 (in the case of the helical antenna according to the present invention)

number of spiral conductors:

4 for outer spiral conductors 4 for inner spiral conductors outer diameter of dielectric cylinder: 0.0705 wavelength inner diameter of dielectric cylinder: 0.0691 wavelength inclination angle of spiral conductors relative to the horizontal:

71 degrees for outer spiral conductors 69 degrees for inner spiral conductors number of turns 1.94 for outer spiral conductors 1.96 for inner spiral conductors height:

1.24 wavelength for outer spiral conductors 1.12 wavelength for inner spiral conductors power supply loss:

1.2 dB for both spiral conductors

In the result of FIG. 4, the variation of the radiation pattern due to the frequency characteristic is great, and the gain is equal to 1.2 dBi at a maximum at the transmission frequency of 0.949 f0 and at the elevation angle of 20 degrees. On the other hand, in the result of FIG. 5, 2 dBi which is a desired value can be achieved at the elevation angle of 20 degrees in both of the transmission band and reception band because the calculation is performed on the basis of optimization in both of the transmission band and the reception band.

As explained above, in the case of the helical antenna, when the frequency varies, the beam direction is generally displaced. This is clearly apparent from the result of FIG. 4. In FIG. 4, the coverage of the gain 2 dBi is about 27 degrees ranging from 24 degrees to 51 degrees. However, by using the helical antenna of the present invention, the coverage is equal to 37 degrees ranging from 20 degrees to 57 degrees as shown in FIG. 5, and thus the coverage is increased to about 1.4 time.

In the above embodiment, the number of the outside spiral conductors is equal to 4 and the number of the inside spiral conductors is also equal to 4. However, the numbers of the outside and inside spiral conductors are not limited to these values, and it is needless to say that the same effect can be obtained even if the numbers of the outside and inside spiral conductors are set to m and n (m, n represent natural numbers), respectively.

Further, when the numbers of the outside or inside spiral conductors are equal to 2, the corresponding power supply circuit supplies power while shifting the phase of the power by $\pi$[rad]. In general, when the number of the spiral conductors is n (n represents natural number), the corresponding power supply circuit supplies power while shifting the phase of the power by $2\pi/n$ [rad].

As explained above, according to the helical antenna of the present invention, the frequency bandwidth of the antenna can be widened, and it can be achieved at a small size.

Although the present invention has been shown and explained with respect to the best mode embodiments thereof, it should be understood by those skilled in the art that the foregoing and various other changes, omissions, and additions in the form and detail thereof may be made therein without departing from the spirit and scope of the present invention.

What is claimed is:

1. A helical antenna comprising a cylindrical dielectric member, m members of a first helical conductor which are wound around an outer wall of said cylindrical dielectric member, m representing a natural number, said m members of the first helical conductor covering a first frequency band, n members of a second helical conductor which are attached to an inner wall of said cylindrical dielectric member, n representing a natural number, said n members of the second helical conductor covering a second frequency band, a first power supply circuit for supplying high-frequency powers to said members of the first helical conductor on the outer wall of said cylindrical dielectric member, and a second power supply circuit for supplying high-frequency powers to said members of the second helical conductor on the inner wall of said cylindrical dielectric member, wherein an angle of each of said m members of the first helical conductor relative to a horizontal direction is different from an angle of each of said n members of the second helical conductor relative to the horizontal direction, and wherein a length of each of said m members of the first helical conductor is different from a length of each of said n members of the second helical conductor, whereby a beam radiation direction of said first frequency band is the same as a beam radiation direction of said second frequency band.

2. The helical antenna as set forth in claim 1, wherein said first power supply circuit supplies said high-frequency powers which is shifted by $2\pi/m$ radian in phase one after another to said members of helical conductors which are wound around the outer wall and said second power supply circuit supplies said high-frequency powers which is shifted by $2\pi/n$ radian in phase one after another to said members of helical conductors which is attached to the inner wall.

3. The helical antenna as set forth in claim 1, wherein m and n are equal to 4, and said first power supply circuit applies said high-frequency powers to said four helical conductors on the outer wall of said cylindrical dielectric member while shifting the phase by $\pi/2$ radian one after another, and said second power supply circuit supplies said high-frequency powers to said four helical conductors on the inner wall of said cylindrical dielectric member while shifting the phase by $\pi/2$ radian one after another.

4. The helical antenna as set forth in claim 1, wherein m and n are equal to 2, and said first power supply circuit supplies said high-frequency powers to said two helical conductors on the outer wall of said cylindrical dielectric member while shifting the phase by $\pi$ radian one after another, and said second power supply circuit supplies said high-frequency powers to said two helical conductors on the inner wall of said cylindrical dielectric member while shifting the phase by $\pi$ radian one after another.

5. The helical antenna as set forth in claim 1, wherein m and n are equal to 1.

6. The helical antenna as set forth in claim 1, wherein said cylindrical dielectric member has the diameter which is about one tenth of the wavelength of the frequency being used, and the thickness which is about one hundredth of the wavelength of the frequency being used or less.

7. The helical antenna as set forth in claim 1, wherein said members of helical conductor are linear conductors which are inclined at a predetermined angle relative to the horizontal, and the width of said helical conductors is three hundredth of wavelength or less.

8. A helical antenna comprising a cylindrical member, m members of a first helical conductor wound around an outer wall of said cylindrical member, m representing a natural number, said m members of the first helical conductor covering a first frequency band, n members of a second helical conductor attached to an inner wall of said cylindrical member, n representing a natural number, said n members of the second helical conductor covering a second frequency band, power supply means for supplying high-frequency powers to said members of the first helical conductor and for supplying high-frequency powers to said members of the second helical conductor, wherein an angle of each of said m members of the first helical conductor relative to a horizontal direction is different from an angle of each of said n members of the second helical conductor relative to the horizontal direction, wherein a length of each of said m members of the first helical conductor is different from a length of each of said n members of the second helical conductor, and a beam radiation direction of said first frequency band is the same as a beam radiation direction of said second frequency band.

9. The helical antenna as set forth in claim 8, wherein said power supply means supplies said high-frequency powers that is shifted by $2\pi/m$ radian in phase one after another to said members of helical conductors which are wound around the outer wall and supplies said high-frequency powers which is shifted by $2\pi/n$ radian in phase one after another to said members of helical conductors which is attached to the inner wall.

10. The helical antenna as set forth in claim 8, wherein m and n are equal to 4, and said power supply means applies said high-frequency powers to said four helical conductors on the outer wall of said cylindrical member while shifting the phase by $\pi/2$ radian one after another, and said power supply means supplies said high-frequency powers to said four helical conductors on the inner wall of said cylindrical member while shifting the phase by $\pi/2$ radian one after another.

11. The helical antenna as set forth in claim 8, wherein m and n are equal to 2, and said power supply means supplies said high-frequency powers to said two helical conductors on the outer wall of said cylindrical member while shifting the phase by $\pi$ radian one after another, and said power supply means supplies said high-frequency powers to said two helical conductors on the inner wall of said cylindrical member while shifting the phase by $\pi$ radian one after another.

12. The helical antenna as set forth in claim 8, wherein m and n are equal to 1.

13. The helical antenna as set forth in claim 8, wherein said cylindrical member has the diameter that is about one tenth of the wavelength of the frequency being used, and the thickness which is about one hundredth of the wavelength of the frequency being used or less.

14. The helical antenna as set forth in claim 8, wherein said members of helical conductor are linear conductors that are inclined at a predetermined angle relative to the horizontal, and the width of said helical conductors is three hundredth of wavelength or less.

* * * * *